US006414644B1

(12) United States Patent
Desargant et al.

(10) Patent No.: US 6,414,644 B1
(45) Date of Patent: Jul. 2, 2002

(54) CHANNELED SURFACE FAIRING FOR USE WITH A PHASED ARRAY ANTENNA ON AN AIRCRAFT

(75) Inventors: Glen J. Desargant; Robert Dietterle, both of Fullerton, CA (US); Marcus Berry, Des Moines, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/955,477

(22) Filed: Sep. 18, 2001

(51) Int. Cl.[7] ..... H01Q 1/28
(52) U.S. Cl. ..... 343/705; 343/708
(58) Field of Search ..... 343/705, 708, 343/711, 712, 713, 700 MS; H01Q 1/28

(56) References Cited

U.S. PATENT DOCUMENTS 4,838,502 A 6/1989 Pinson ..... 244/49
4,955,562 A * 9/1990 Martin et al. ..... 343/705
5,666,128 A * 9/1997 Murray et al. ..... 343/878
5,986,611 A 11/1999 Harrison et al. ..... 343/705
6,204,820 B1 3/2001 Jensen, Jr. ..... 343/713

* cited by examiner

*Primary Examiner*—Hoanganh Le
(74) *Attorney, Agent, or Firm*—Harness Dickey & Pierce P.L.C.

(57) ABSTRACT

A fairing for use with a phased array antenna for attenuating the transverse magnetic (TM) electric field radiated by the antenna, to thereby reduce the possibility of interference with other transceivers operating in the area of the antenna but which are not the intended recipients of a signal transmitted by the antenna. The fairing is adapted to be secured to an outer surface of a fuselage of an aircraft and to support the phased array antenna thereon. The fairing includes a plurality of concentrically arranged channels that serve to capture and ground the TM electric field as it propagates along the plane of the fairing away from the phased array antenna. Advantageously, the phased array antenna is mounted on the fairing so that the fairing also acts as a heat sink to help cool the antenna. In one preferred form the fairing is made from aluminum.

20 Claims, 5 Drawing Sheets

CHANNELED SURFACE FAIRING FOR USE WITH A PHASED ARRAY ANTENNA ON AN AIRCRAFT

FIELD OF THE INVENTION

This invention relates to antenna assemblies, and more particularly to a fairing for use with a phased array antenna mounted on a mobile platform for attenuating transfer of electromagnetic radiation emitted by the antenna into the mobile platform, and therefore reducing the possibility of unwanted interference with various forms of RF receivers in the vicinity of the aircraft.

BACKGROUND OF THE INVENTION

Phased array antennas are presently being used on aircraft to form a communications link between the aircraft and a ground station via one or more satellite-based RF transponders. Such phased array antennas described above, when used with aircraft, may be used in the Ku-band (14 GHz–14.5 GHz). In this frequency band, the ability to avoid interfering with other RF receivers or transceivers is extremely important. Any such system operating in this frequency band will be subject to strict regulations on interference promulgated by the Federal Communications Commission (FCC) as well as the International Telecommunications Union (ITU), if the system is to be used in the airspace over Europe. Phased array antennas, however, typically exhibit some electromagnetic radiation, known as the "sidelobes" and "backlobes" of the radiated signal, which are undesirable components of the radiated signal, and which require attenuation in order to ensure that they do not result in interference with other RF receivers, whether land based or on other mobile platforms, operating in the vicinity of the aircraft.

With phased array antennas, the main beam radiated therefrom can be scanned away from the boresight of the antenna. The sidelobes and backlobes from 90° to 120° off the boresight form the source of the interference of concern. This radiation, if not attenuated, may radiate along the surface of the aircraft and then toward the ground in the vicinity of the aircraft.

It would therefore be highly desirable to provide some form of apparatus which can be used with a phased array antenna, when the antenna is mounted on a vehicle such as an aircraft, to attenuate the sidelobes and backlobes to a significant degree without otherwise affecting the performance of the antenna. More specifically, it would be highly desirable to provide some form of apparatus which can be secured to an exterior surface of the aircraft or other form of vehicle, and which can be used to not only support the phased array antenna thereon but also to significantly attenuate transverse magnetic (TM) waves radiated from the antenna which would otherwise pose a risk of interference with ground-based RF receivers operating in the vicinity of the aircraft.

It would also be highly desirable to provide such an apparatus as described above which can be secured to an exterior surface of an aircraft without significantly altering the moldline of the aircraft, and without significantly altering the aerodynamics of the aircraft. Still further, it would be highly desirable if such an apparatus could also function as a heat sink for the phased array antenna to help maintain the antenna cool during extended periods of use.

SUMMARY OF THE INVENTION

The present invention is directed to a fairing for use with a phased array antenna mounted on a vehicle. In one preferred form the fairing is adapted to be mounted on an exterior surface of a commercial aircraft, although it will be appreciated that the fairing could be adapted for use on a wide range of vehicles such as trucks, buses, trains and even ships. Accordingly, it will be appreciated that the present invention is not limited to use strictly with aircraft.

In one preferred embodiment the fairing comprises an aluminum plate which is adapted to be mounted to the exterior surface of an aircraft. The plate includes a plurality of channels or grooves formed in an outer surface thereof which serves to significantly attenuate the transverse magnetic waves radiated from a phased array antenna mounted adjacent to, or directly on, the fairing. In the preferred embodiment the fairing includes a recess formed in the upper surface thereof for supporting the phased array antenna therein. The channels are also formed as a plurality of concentric channels with the phased array antenna disposed concentrically within an innermost one of the channels. The channels may be formed in a square shaped pattern, a circular pattern or any other pattern which at least substantially, but preferably completely, circumscribes the phased array antenna supported thereon.

In one preferred embodiment, the width of each channel is equivalent to one quarter wave length of a frequency of a signal radiated from the phased array antenna. Preferably, each of the channels is separated by a distance which is less than the width of each channel, and more preferably which is about one half the width of each channel or, put differently, approximately one half wavelength of a frequency of a signal radiated by the antenna.

In an alternative preferred embodiment of the fairing of the present invention, each of the channels are filled with a low loss dielectric material which has mechanical and thermal characteristics similar to the material used for the fairing. This improves the aerodynamic efficiency of the fairing.

The fairing of the present invention has a very low, aerodynamic profile and can be used under a full radome which covers the phased array antenna and the fairing, or within a partial radome, or with no radome. If no radome is used, then it is preferred that the channels be filled with the low loss dielectric described above.

The fairing of the present invention has been found to reduce the amplitude of the sidelobes and backlobes at 90°–120° from the boresight axis of a phased array antenna by about 10 db to 25 db when the antenna's main beam is scanned to 60° off of its boresight. Accordingly, the attenuation provided by the fairing is significant in reducing the TM radiation which would otherwise be generated by a phased array antenna during use thereof.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 6 is a graph showing the improvement in the attenuation of the sidelobes of a signal from a phased array antenna when the fairing of the present invention is used.

DETAILED DESCRIPTION OF THE PREFERRED EMBODIMENTS

The following description of the preferred embodiment(s) is merely exemplary in nature and is in no way intended to limit the invention, its application, or uses.

Figure 1:
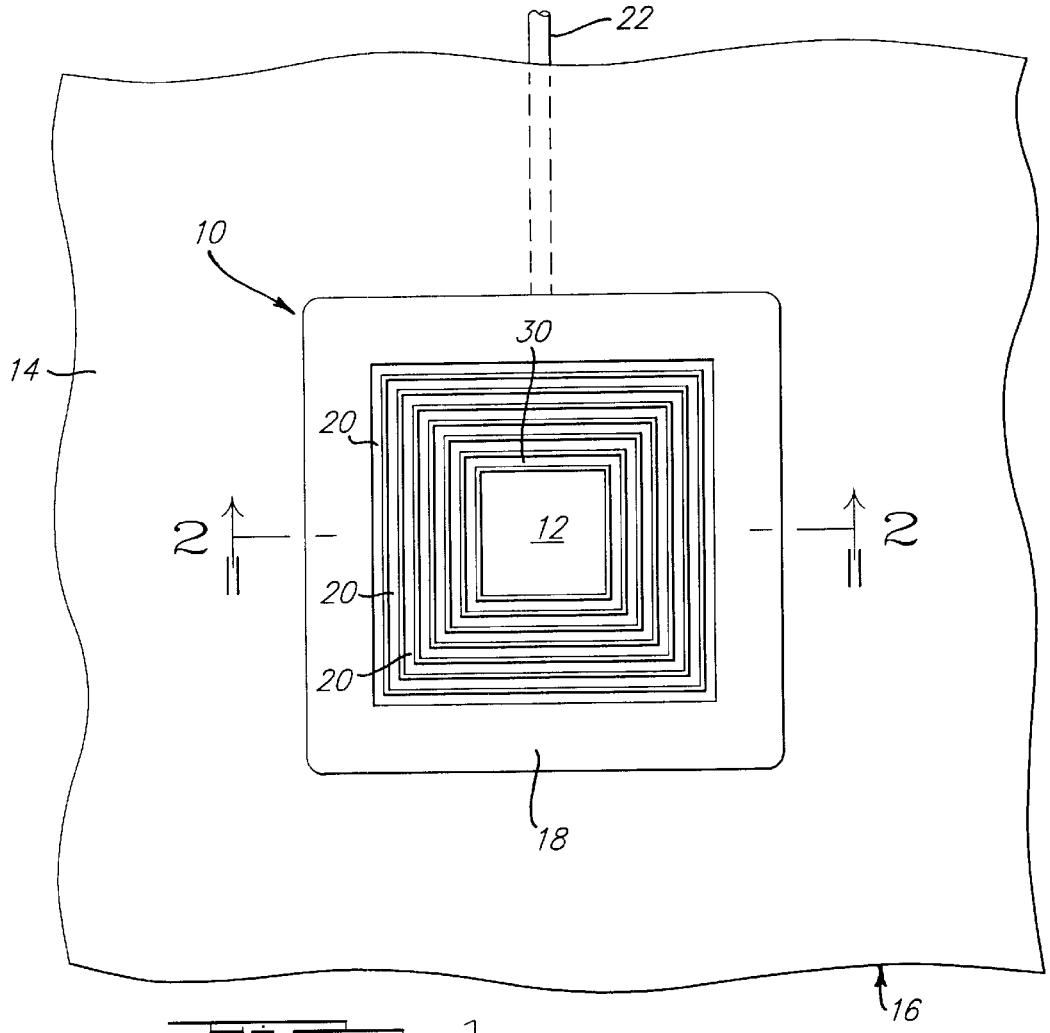
FIG. 1 is a simplified plan view of a fairing in accordance with a preferred embodiment of the present invention, together with a highly simplified illustration of a phased array antenna supported thereon, and where the fairing of the present invention is mounted on a fuselage of an aircraft.

Referring to FIG. 1, there is shown a fairing 10 in accordance with a preferred embodiment of the present invention. The fairing 10 is shown with a phased array antenna 12 supported thereon. The fairing 10 generally forms a planar panel or plate and is adapted to be secured by any suitable means to an exterior surface 14 of an aircraft fuselage 16. It will be recognized immediately, however, that the fairing 10 is not limited in its application to only aircraft. The fairing 10 of the present invention can be employed with virtually any form of vehicle on which a phased array antenna is carried. Such vehicles may include, but are not limited to, buses, trucks, trains and even ships.

The fairing 10 preferably comprises a solid section of material, for example, aluminum, which is secured such as by mechanical fastening elements such as rivets or any other suitable fastening means to the exterior surface 14 of the fuselage 16. On an upper surface 18 of the fairing 10, a plurality of concentric channels 20 are formed. A suitable wiring harness 22 is coupled to the antenna 12. The harness 22 extends to an area within the interior of the aircraft and carries RF, beam steering and power supply cables which are interfaced to the antenna 12. These cables allow the antenna 12 to be controlled by suitable antenna control equipment carried on the aircraft.

Figure 2:
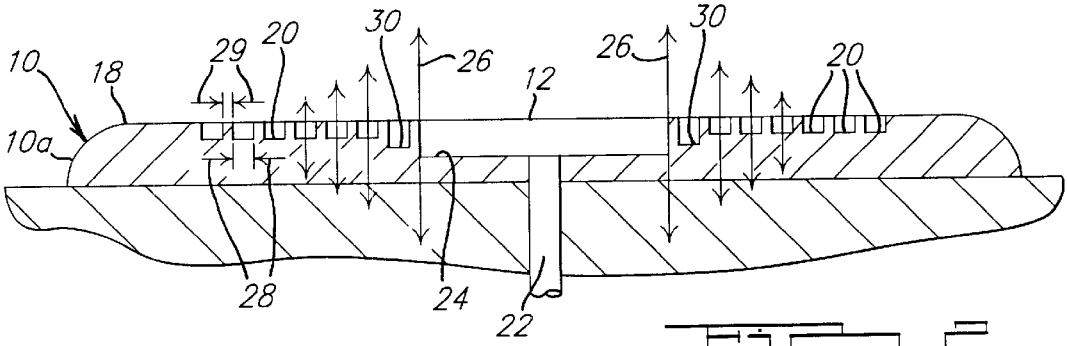
FIG. 2 is a side cross-sectional view of the fairing of FIG. 1 in accordance with section line 2—2 in FIG. 1.

Referring to FIG. 2, the fairing 10 includes a recess 24 formed within the upper surface 18 thereof for receiving and supporting the antenna 12. Mounting of the antenna 12 on the fairing 10 in this manner also allows the fairing 10 to act as a heat sink to help cool the antenna 12 during periods of extended use. Arrows 26 represent the TM mode radiation which radiates from the antenna 12 outwardly along the entire surface of the fairing 10 towards its outermost periphery 10*a*. These TM waves are the source of the sidelobes and backlobes of the main signal radiated from the antenna 12. As explained herein, the sidelobes and backlobes of the signal radiated from the antenna 12 are highly undesirable because of their ability to cause interference with other receivers or transceivers operating within the vicinity of the aircraft.

With further reference to FIG. 2, the channels 20 operate to significantly attenuate the TM waves radiating outwardly along the fairing 10 from the phased array antenna 12. In effect, the channels 20 serve to capture and short the vertical electric field (i.e., TM waves) moving outwardly along the fairing 10. This is represented by the decreasing length of the arrows 26 as the arrows 26 approach the outer periphery 10*a* of the fairing 10.

In the preferred embodiment, the width of each channel 20 is preferably approximately one quarter wavelength of a frequency of a signal radiated by the antenna 12. This width is represented by arrows 28 in FIG. 2. The distance separating each channel 20, represented by arrows 29, is preferably less than the width of each channel 20, and more preferably about one eighth wavelength of the signal being radiated by the antenna 12. Preferably, a plurality of concentric channels 20 are provided. More preferably, three such channels 20 are provided per wavelength, with a total number of channels being greater than three such channels 20. The depth of each channel 20 is preferably designed to be one-quarter wavelength at the lowest frequency of operation ($F_{low}$) of the antenna 12. A matching section 30 is also provided for better directing the TM wave into the fairing 10 as the TM wave initially propagates away from the antenna 12. The matching area 30 consists of at least one innermost channel circumscribing the antenna 12 and having a depth which is preferably slightly greater than the depth of each of channels 20. Matching area 30 preferably has a depth which is one-half wavelength at the highest frequency of operation ($F_{high}$), and preferably slightly greater than the depth of each of channels 20. Matching area 30 more preferably could incorporate at least four channels having a width of at least three per wavelength (same as channels 20).

Figure 5:
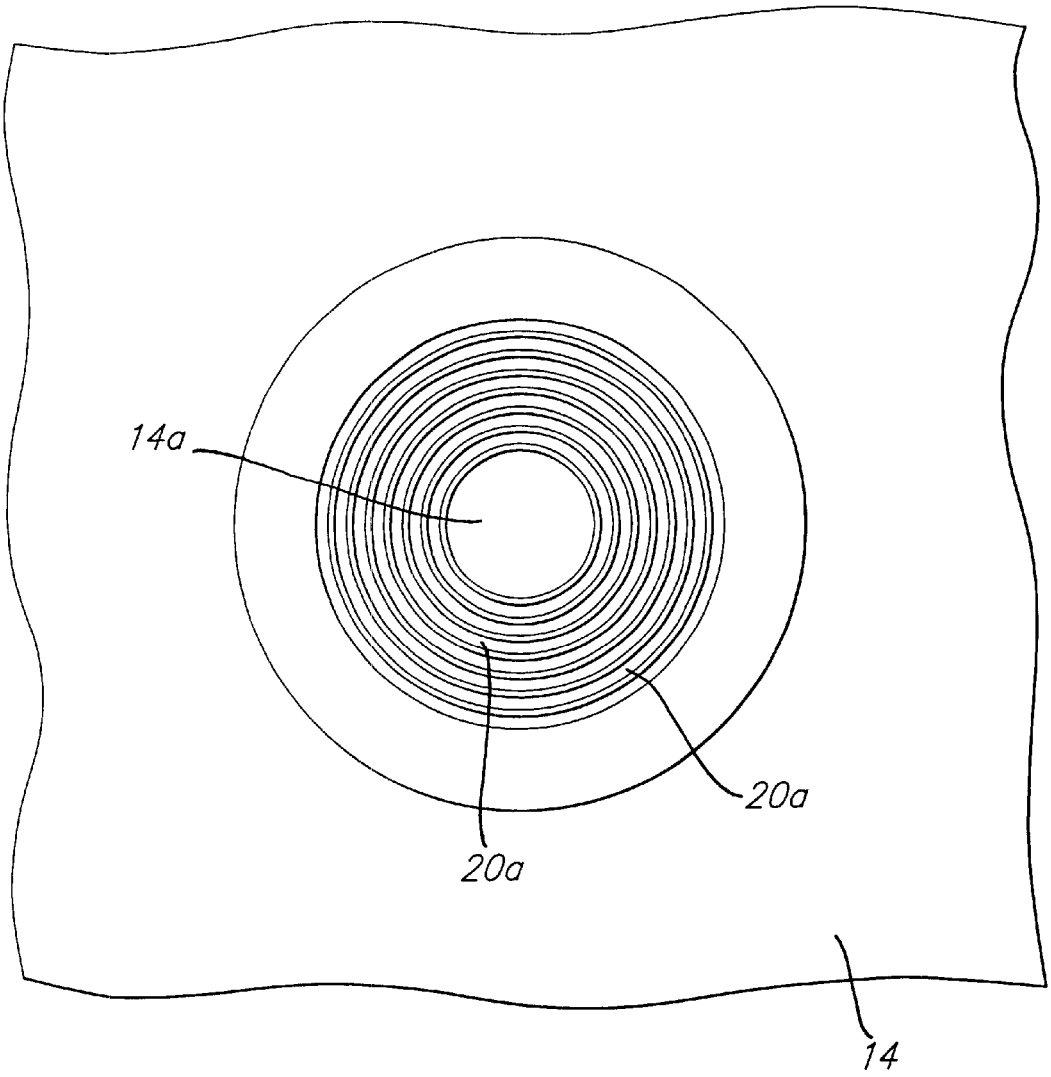
FIG. 5 is a plan view of a circular fairing in accordance with an alternative preferred embodiment of the present invention.
Figure 5:
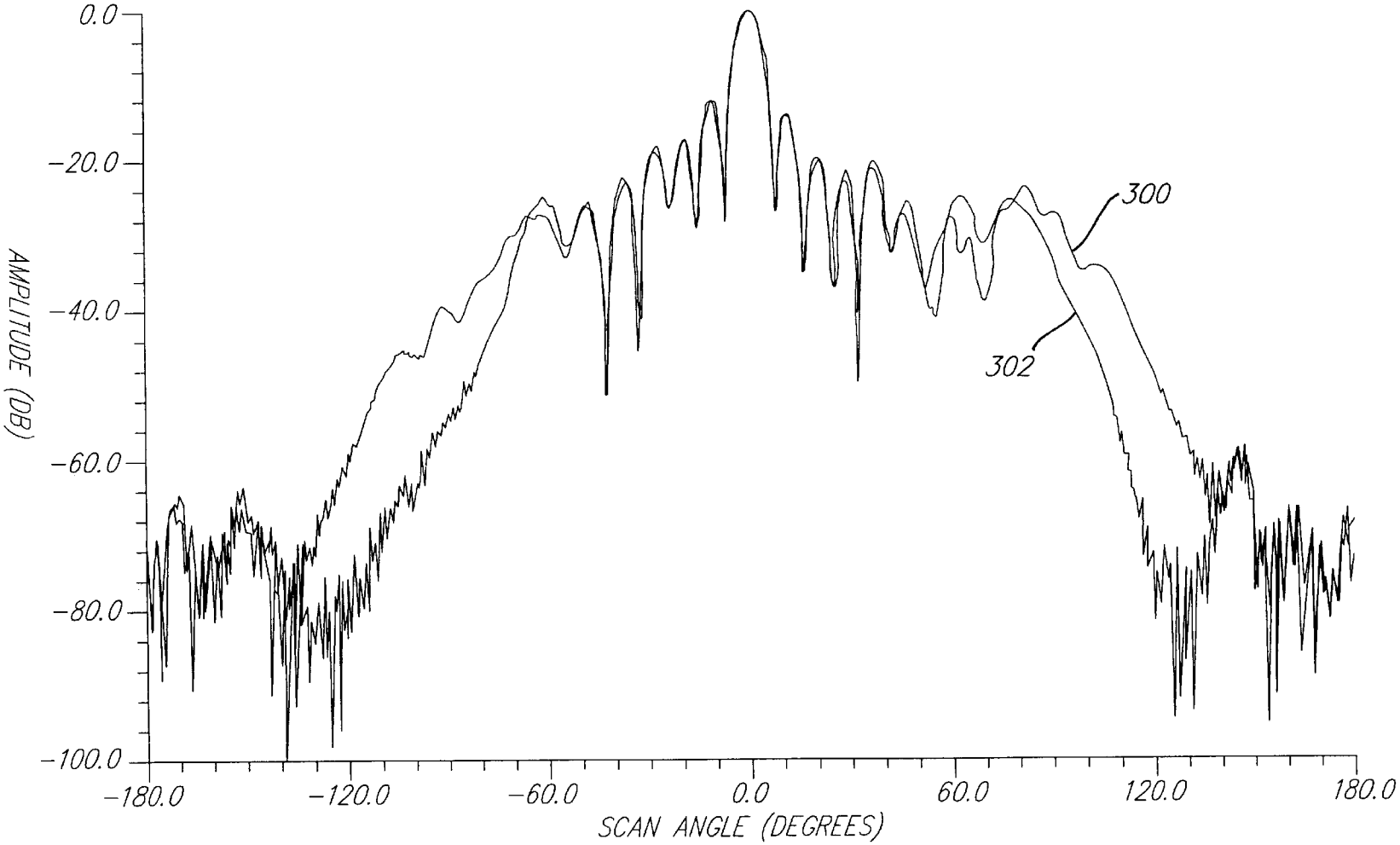

It will be appreciated that while the fairing 10 is illustrated as one single, integrally formed component, that the fairing 10 could just as easily be provided by a plurality of independent metallic, panel-like sections joined into a single assembly by a suitable frame. Also, the shape of the fairing 10 could be in the form of a circle with circular concentric channels 20*a* formed around a circular phased array antenna 14*a*, as illustrated in FIG. 5. The fairing could, in fact, be formed in other shapes such as a rectangle, a pentagon, octagon or any other shape to suit the needs of a specific application.

Figure 3:
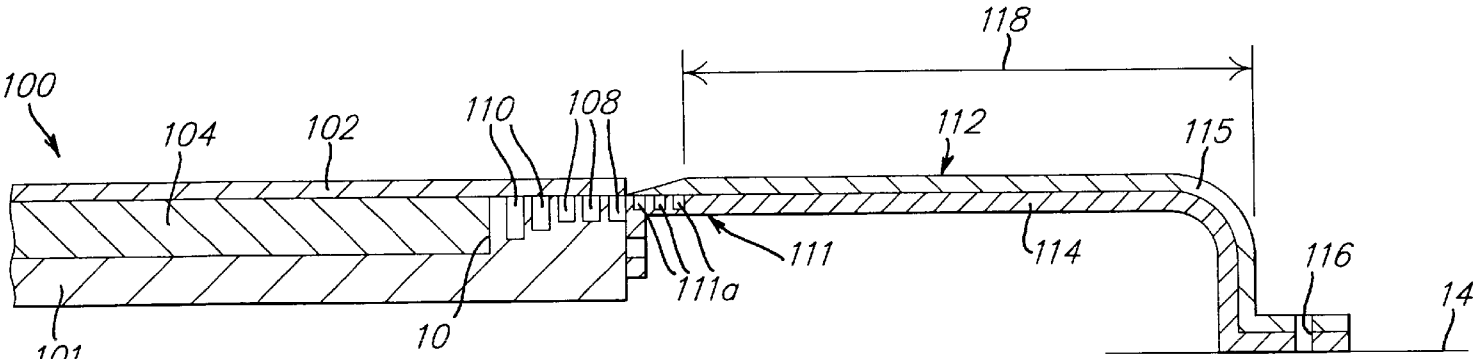
FIG. 3 is a partial side cross-sectional view of an alternative preferred embodiment of a fairing assembly in accordance with the present invention.

Referring to FIG. 3, a fairing assembly 100 in accordance with an alternative preferred embodiment of the present invention is illustrated. The fairing assembly 100 is shown with a dielectric layer 102 disposed over a metallic panel or plate 101 so as to encapsulate a phased array antenna 104 supported within a recess 106 of the metallic plate 101. Fairing assembly 100 includes a plurality of channels 108 formed in the metallic plate 101 for attenuating the transverse magnetic waves radiated from the antenna 104, as well as channels 110 which form a matching section to initially help direct the TM wave into the fairing assembly 100. The embodiment shown in FIG. 3 further includes a RAM (radar absorbing material) matching section 112 comprising a ground plane 114 and a layer of RAM material 115. The ground plane 114 preferably comprises a metallic ground plane, and more preferably an aluminum ground plane. A RAM matching section 111 having a plurality of channels 111*a* forms a transition for further assisting and channeling TM waves into the RAM attenuating section 112. Channels 111*a* are preferably similar in width and spacing as channels 108, which are in turn similar or identical in width and spacing to channels 20 described in connection with FIG. 2. A plurality of openings 116 are included for use with fastening elements such as rivets or threaded fasteners for securing the ground plane 114 and its RAM attenuating section 112 to the outer surface of the fuselage 14. The width of the RAM attenuating section 112, as indicated by arrow 118, is preferably 3–4 inches in width, but it will be appreciated that this dimension could vary significantly to suit a specific application of the fairing assembly 100. The RAM attenuating section 112 is also preferably disposed in the plane of the aperture of the phased array antenna 104 or slightly above the plane of the aperture, as illustrated in FIG. 3.

Figure 4:
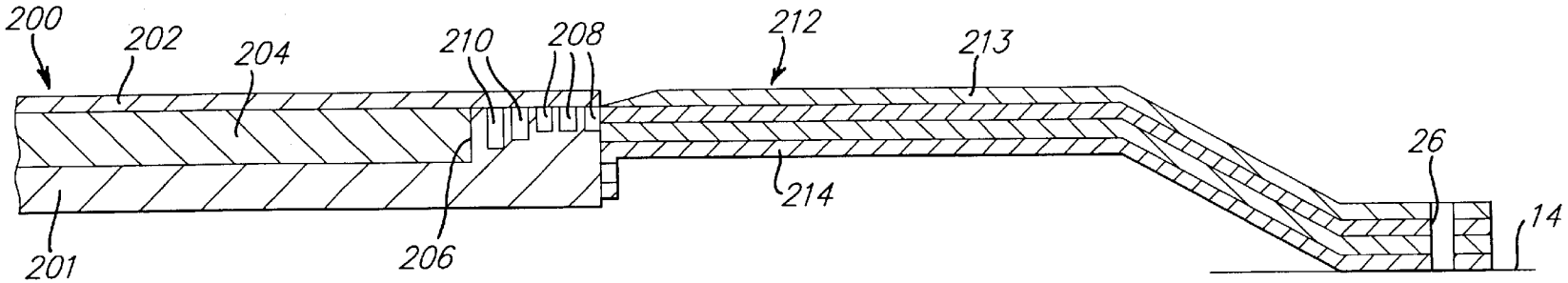
FIG. 4 is another alternative preferred embodiment of a fairing assembly of the present invention.

FIG. 4 illustrates a fairing assembly 200 in accordance with yet another alternative preferred embodiment of the present invention. Fairing assembly 200 is similar to fairing assembly 100, and includes a dielectric layer 202 disposed over a metallic, preferably aluminum, panel or plate 201 the fairing assembly 200, a phased array antenna 204 disposed within a recess 206 formed in the plate 201, a plurality of channels 208 for attenuating TM waves, and a matching section 210 for better directing the TM waves into the plate 201. The difference between fairing assembly 100 and fairing assembly 200 is the use of a matching section 212 having a multi-layer, variable density gradient RAM layer 213 disposed over a ground plane 214. The ground plane 214 is also preferably an aluminum ground plane. An opening 216 is used to secure the matching section 212 to the outer surface of the fuselage 14. The matching section 212 forms an extension of fairing panel 201 which further helps to attenuate TM waves radiated from the antenna 204.

It will be appreciated that each of the embodiments 10, 100 and 200 of the fairing of the present invention can be used with (i.e., covered by) either a full radome, a partial radome or no radome whatsoever. However, reliability and wear and tear may dictate that fairings 100 and 200 be used with either a partial or full radome to combat wear and tear caused by the elements. If no radome is used, then it will be preferable to fill or cover the channels in the metallic plate forming the fairing with a low loss dielectric to improve the aerodynamics of the fairing 10, 100 or 200.

Referring now to FIG. 6, a comparison of the signals transmitted by a phased array antenna having a conventional aluminum fairing and a phased array antenna mounted on the fairing of the present invention is shown. Waveform 300 represents the waveform generated by a phased array antenna being used with a conventional aluminum fairing, while waveform 302 represents a waveform generated by the antenna 12 used in connection with fairing 10 of the present invention. It will be noted that the attenuation in amplitude (dB) at 90° has been reduced by about 7.5 dB. At 120°, the reduction and amplitude increases to 25 dB. This represents an improvement in attenuation by a factor of 10 to 300 times. The 90°–120° spectrum is especially important on an aircraft, because it is within this range that the sidelobes and backlobes of the radiated signal are most likely to interfere with ground based RF transceivers below the aircraft.

Figure 7:
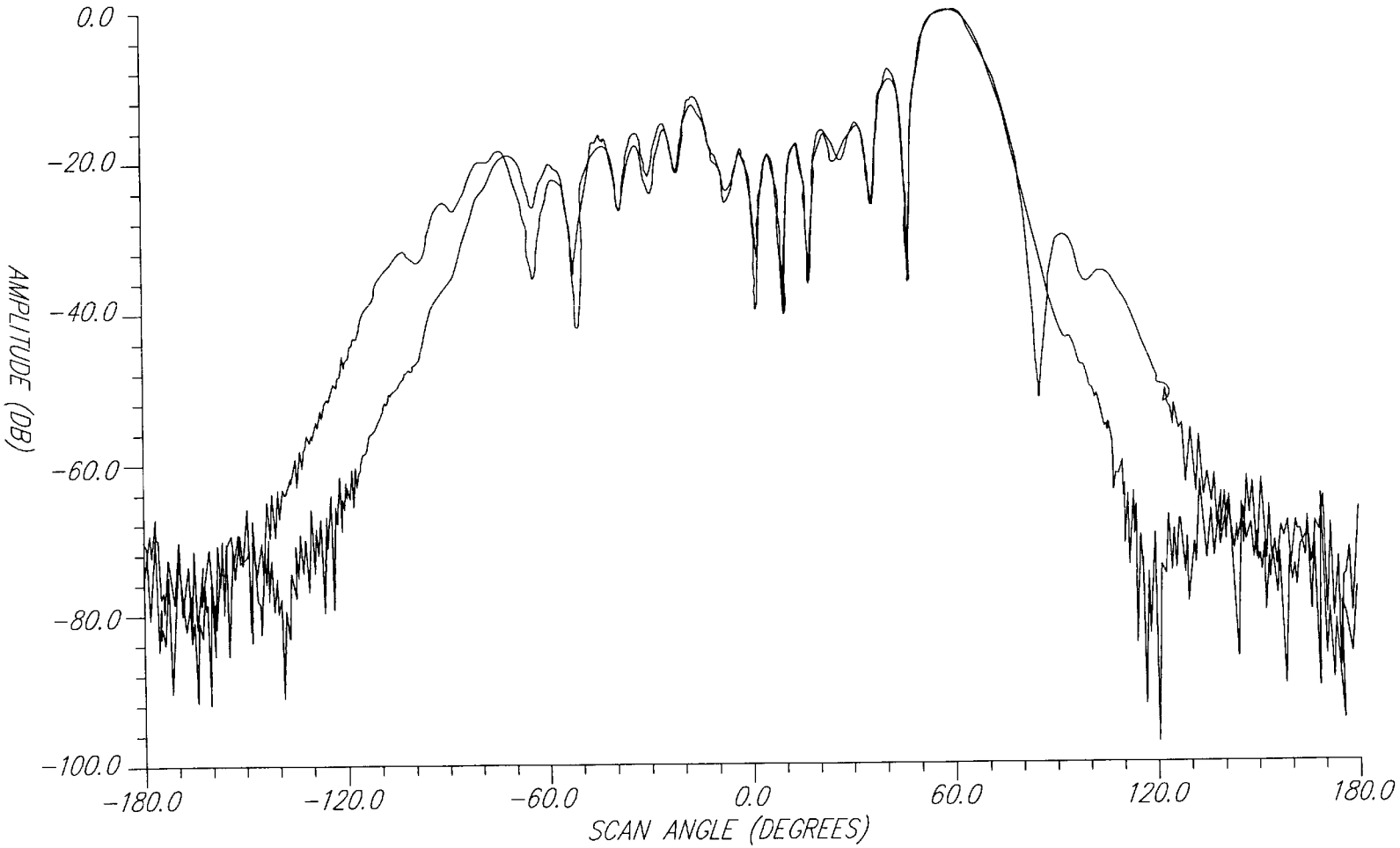
FIG. 7 is a graph showing the improvement in attenuation of the sidelobes of a signal when the fairing of the present invention is used, and when the main beam of the antenna is scanned to 60° off of boresight of the antenna.

FIG. 7 shows a graph of the improvement in the attenuation of the sidelobes of a signal transmitted from the antenna 12 with the antenna main beam scanned to 60°. Again, at 90° and 120° from the boresight of the antenna, significant improvement can be seen in the attenuation of the sidelobe of the main beam.

The fairing of the present invention thus provides a means to significantly attenuate the TM radiation generated by a phased array antenna. While the present invention is especially well suited for use on aircraft incorporating a phased array antenna on an outer surface of a fuselage thereof, it will be appreciated that the present invention can be used on virtually any vehicle or on any structure in which the attenuation of the TM electric field generated by a phased array antenna is of concern and requires significant attenuation to avoid interference problems with other transceivers in the vicinity.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A fairing adapted for use with a phased array antenna used on a vehicle and adapted to be secured to an exterior surface of said vehicle, said fairing comprising:

a panel having an upper surface and a lower surface, wherein said lower surface is adapted to be secured to said exterior surface of said vehicle adjacent said phased array antenna; and a plurality of channels formed in said upper surface for attenuating transverse electromagnetic (TM) waves radiating from said phased array antenna.

2. The fairing of claim 1, wherein said fairing comprises a generally planar panel having a centrally disposed recess for housing said phased array antenna.

3. The fairing of claim 1, wherein said channels are formed generally parallel to one another.

4. The fairing of claim 1, wherein said channels comprise a plurality of concentrically arranged channels formed in said upper surface of said panel.

5. The fairing of claim 4, wherein said panel includes a recess disposed centrally thereon within innermost one of said concentrically arranged channels.

6. The fairing of claim 1, wherein said channels are spaced apart by a distance of ¼ wavelength of the signal radiating from said phased array antenna.

7. The fairing of claim 1, wherein each said channel comprises a width which is greater than a distance separating it from its adjacent said channel.

8. The fairing of claim 1, wherein said fairing is comprised of aluminum.

9. A fairing adapted for use with a phased array antenna used on a vehicle and adapted to be secured to an exterior surface of said vehicle, said fairing comprising:

a panel having an upper surface and a lower surface, wherein said lower surface is adapted to be secured to said exterior surface of said vehicle, said panel further being adapted to support said phased array antenna thereon; and a plurality of generally concentric channels formed in said upper surface for attenuating transverse electromagnetic (TM) waves radiating from said phased array antenna, said concentric channels being arranged to at least partially circumscribe said phased array antenna.

10. The fairing of claim 9, wherein said panel comprises a recess in said upper surface for supporting said phased array antenna, said recess being located so as to be concentric with said channels.

11. The fairing of claim 9, wherein said panel is comprised of aluminum.

12. The fairing of claim 9, wherein said channels are covered with a low loss dielectric material.

13. The fairing of claim 9, wherein said channels each have a width which is greater than a distance separating each said channel from its adjacent said channel.

14. The fairing of claim 9, wherein said channels each have a width which is approximately twice a distance which separates adjacent ones of said channels.

15. The fairing of claim 9, wherein at least one of said channels has a width which is approximately equivalent to ¼ wavelength of a frequency of a signal radiating from said phased array antenna.

16. The fairing of claim 9, wherein a distance separating adjacent ones of said channels comprises a distance equivalent to approximately ⅛ wavelength of a frequency of a signal radiating from said phased array antenna.

17. An antenna assembly adapted to be mounted on an exterior surface of a vehicle, comprising:

a phased array antenna;

a fairing disposed adjacent said phased array antenna, said fairing having an upper surface and a lower surface with said lower surface adapted to be secured to an exterior surface of said vehicle;

said upper surface of said fairing having a plurality of channels formed thereon for attenuating transverse magnetic waves radiating from said phased array antenna.

18. The antenna assembly of claim 17, wherein said channels are concentrically arranged around said phased array antenna.

19. The antenna assembly of claim 18, wherein a width of each said channel is greater than a distance separating each said channel from its nearest adjacent said channel.

20. The antenna assembly of claim 18, wherein a width of each said channel is equal to approximately ¼ wavelength of a frequency of a signal radiating from said phased array antenna.

* * * * *